United States Patent [19]

Daub

[11] 3,998,381

[45] Dec. 21, 1976

[54] APPARATUS FOR REMOVING EXPLOSIVE MATERIAL FROM A CENTRIFUGE BASKET

[75] Inventor: Lorin Richard Daub, Blacksburg, Va.

[73] Assignee: The United States of America as represented by the Secretary of the Army, Washington, D.C.

[22] Filed: Jan. 27, 1976

[21] Appl. No.: 652,942

[52] U.S. Cl. ..... 233/3; 233/46; 210/375

[51] Int. Cl.[2] ..... B04B 11/08

[58] Field of Search ..... 233/1 R, 3, 7, 21, 22, 233/27, 46; 210/375, 372

[56] References Cited

UNITED STATES PATENTS

| | | | |
|---|---|---|---|
| 2,162,199 | 6/1939 | Jones | 233/22 |
| 2,171,839 | 9/1939 | Riel | 233/22 |
| 2,707,561 | 5/1955 | Hertrich | 233/1 R |
| 3,333,765 | 8/1967 | Maurer | 233/22 |
| 3,703,983 | 11/1972 | Tholl | 233/22 X |
| 3,860,167 | 1/1975 | Lascoux | 233/22 |

FOREIGN PATENTS OR APPLICATIONS

| | | | |
|---|---|---|---|
| 1,532,690 | 1/1970 | Germany | 233/1 R |

*Primary Examiner*—George H. Krizmanich
*Attorney, Agent, or Firm*—Nathan Edelberg; A. Victor Erkkila; Max Yarmovsky

[57] ABSTRACT

A spring supported disc holder, having a plurality of discs affixed thereto, is fixedly attached to the rear convex side of a plow member which is rotatably supported within a centrifuge basket. The disc holder assembly provides for the removal of a residual layer of explosive material at the same time that the plow member safely removes a main body of explosive accumulated material from the interior wall of the centrifuge basket.

3 Claims, 3 Drawing Figures

APPARATUS FOR REMOVING EXPLOSIVE MATERIAL FROM A CENTRIFUGE BASKET

GOVERNMENTAL INTEREST

The invention described herein was made in the course of a contract with the Government and may be manufactured, used and licensed by or for the Government for governmental purposes without the payment to me of any royalty thereon.

BACKGROUND OF THE INVENTION

Problems have been encountered in prior art centrifuge wringers in the removal of nitrocotton explosive cake from the basket. The prior art centrifuge wringers usually leave a residual 1 inch thick cake on the screen of the basket in order to prevent damage to the screen, basket and/or plow. Generally, prior art centrifuge devices have top supported baskets which do not run in a true circle, due to the inclusion in the devices of a saucer bearing which allows for gyrations caused by unbalanced or non-symmetrical loading of material being centrifuged. In consideration of this non-symmetrical loading and to insure safety for the operator and the equipment, a clearance is generally set between the plow and the screen basket by a safety stop. The problem with the prior art clearance design was that the aforementioned residual layer had to be manually removed by an operator. Frequently, this hand removal operation resulted in damage to the screen, loss of production capacity, and was a safety hazard to the operator.

SUMMARY OF THE INVENTION

The present invention relates to a plow attachment for removal of explosive cake material from a basket type centrifuge wringer. The present device eliminates the need to hand scrape a centrifuge basket in order to remove a residual layer of explosive cake material that has been left thereon because of non-concentricity of the centrifuge basket and thus substantially shortens the centrifuge wringer cycle. The present invention is capable of removing a residual layer of explosive material on a centrifuge basket during the regular plow cycle. The use of the present invention in centrifuge wringers for a nitrocotton and water slurry reduces basket screen maintenance and eliminates the safety hazard to operating personnel who do the hand scraping.

An object of the present invention is to provide a plow attachment for the removal of residual explosive cake material from the screen of a centrifuge basket wringer at the same time that a plow removes the main body of explosive cake.

Another object of the present invention is to provide a scraper apparatus for the removal of residual explosive cake material from the screen of a centrifuge basket wringer without causing damage to the screen.

Another object of the present invention is to provide a scraping apparatus for the removal of residual explosive cake material from the screen of a centrifuge basket wringer which eliminates the necessity of stopping the centrifuge for hand scraping the basket and thereby shortens the wringer cycle and increases production capacity.

A further object of the present invention is to provide a plow attachment for the removal of residual explosive cake material from the screen of a centrifuge basket wringer with reduction of the safety hazard presented to the personnel doing hand scraping.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
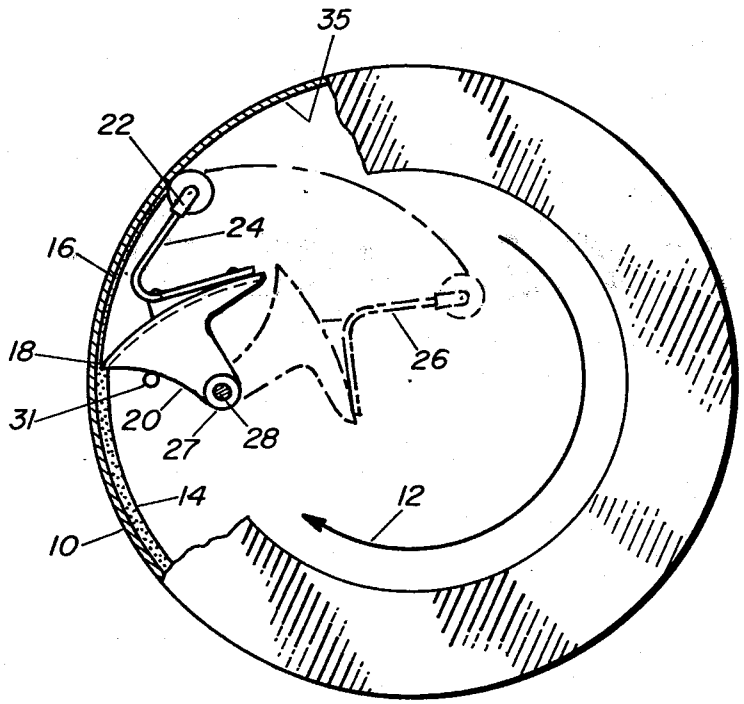
FIG. 1 is a plan view of the scraper apparatus in a removal position in the centrifuge basket, and in a retracted position as shown by dashed lines.

Referring now to FIG. 1 a circularly shaped wringer basket 10 is rotated by a centrifuge mechanism, not shown, in the direction indicated by arrow 12. The basket 10 collects a thick nitrocotton main cake layer 14 which is formed thereon by centrifugal action. A thinner nitrocotton final cake layer 16 remains on the basket 10 after passage of the plowing edge 18 of plow member 20 partially through main cake layer 14. A disc holder or rake-scraper member 22 is biasedly attached to plow 20 by an "L" shaped flat spring 24. The plowing apparatus 26, as indicated by the dash lines, shows the device in its retracted non-plowing position. The retracted position is achieved by manually rotating plow 20 on bearing 27 about plow support shaft 28. Bearing 27 is structurally connected to the plow curved wall 34 by an integral rib member 29 which is integrally connected to the top edge of the curved wall 34. A safety stop member 31 which is fixedly positioned in the centrifuge prevents the plowing edge 18 from coming closer than one inch from the interior wall 35 of basket 10.

Figure 3:
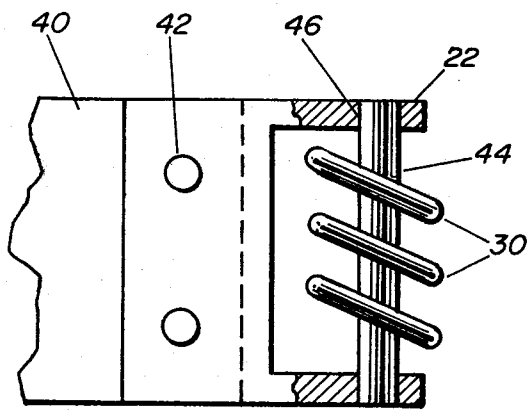
FIG. 3 is an enlarged partial cutaway elevational view of the "rake" or "scratcher" member taken along line 3—3 of FIG. 2.
Figure 2:
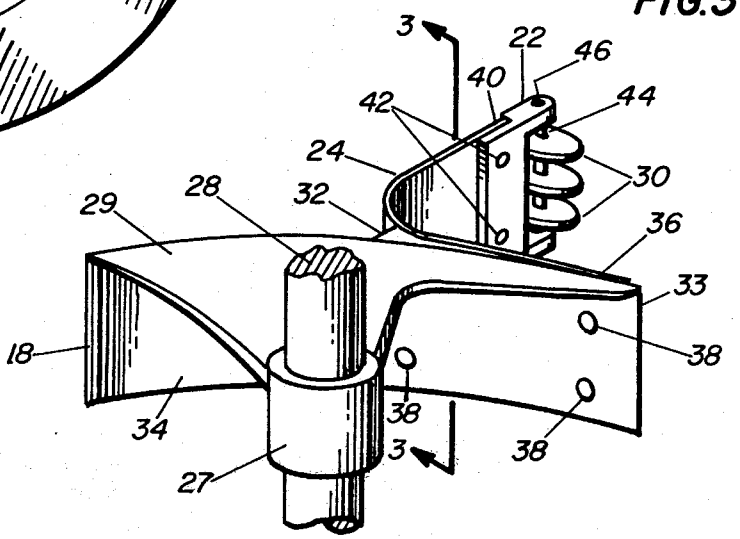
FIG. 2 is in isometric view of the scraper apparatus mounted on a support shaft.

Referring now to FIGS. 2 and 3, L shaped spring 24 provides the biasing force to rub a plurality of fixedly positioned discs 30 against the nitrocotton final cake layer 16 shown in FIG. 1. A wedge shaped spacer 32 provides support for holding L shaped spring 24 at a proper angle with respect to the plow curved wall 34. The spring 24 is fixedly attached on one end 36 to the rear end convex side 33 of curved plow wall 34 by rivets 38 with the spacer 32 fixedly held therebetween. The "U" shaped disc holder member 22 is fixedly attached to the free end 40 of the L spring 24 by rivets 42. The discs 30 are permanently attached to a disc holder shaft 44 which is in turn fixedly attached to disc holder 22 after being inserted in holder shaft bores 46.

In operation, after a nitrocotton and water slurry are loaded into the wringer basket 10, a nitrocotton cake 14 is formed on the wringer basket wall by centrifugal action. The nitrocotton cake 14 is wrung to a final moisture content by the centrifuge mechanism. The cake layers 14 and 16 are then removed by manually moving the plowing apparatus from its retracted position 26 to a removal position as shown in FIG. 1. The plow 20 is turned about shaft 28 toward the upper basket wall and gradually slidably moved along shaft 28 so that plow 20 proceeds vertically down the interior wringer basket wall 35. The nitrocotton final cake 16 remains on the wringer basket wall after the leading plow edge 18 passes because the plow is restrained from coming closer than 1 inch from the basket interior wall by the safety stop 31. The 1 inch clearance distance is necessary so that the plow 20 does not contact the interior wringer basket wall 35. The disc holder rake member 22 moves with the plow 20 and the discs 30 contact the nitrocotton final cake layer 16. The discs 30 rub the nitrocotton final cake layer 16 causing the layer 16 to break up due to the pressure applied by the spring on the disc holder rake member 22. The broken pieces of nitrocotton cake 14 and 16 fall by gravity to the bottom of the basket 10 thus allowing all of the nitrocotton cake to be removed in one continuous operation. The disc holder rake member attachment 22 to the plow member 20 moves with and follows the irregular motion of the basket wall due to the biasing action of spring 24, and therefore eliminates damage to the basket wall 35. When the plowing and scraping operation is completed, the plow apparatus is rotatably moved to its retracted position 26 and slidably moved along shaft 28 in a direction toward the upper basket wall thus ending the wringer cycle.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. An apparatus for safely removing explosive nitrocotton caked material from a circularly shaped wringer basket of a centrifuge which comprises:

shaft support means for rotatably and slidably holding said apparatus when in a removal and a retract position;

plow means, operatively disposed on said shaft support means, for removing a main explosive layer from said wringer basket;

a stop member fixedly positioned in said centrifuge for providing a safety clearance space between said plow means and the interior wall of said basket;

rake means biasedly attached to said plow means for removing a residual explosive nitrocotton layer from said basket.

2. An apparatus as recited in claim 1 wherein said plow means comprises:

an arcuate wall member having a front plowing edge and a rear end;

a rib member connected to the top edge of said arcuate wall member and extending in a normal direction therefrom;

a bearing member connected to said rib member for rotatably and slidably moving on said shaft support means; said bearing member permitting the movement of said plow means against and away from explosive nitrocotton caked material.

3. An apparatus as recited in claim 1 wherein said rake means comprises:

an L shaped spring member having a first end and a fixed end, said fixed end being riveted to the convex side of the rear end of said arcuate wall member;

a spacer fixedly positioned intermediate the convex side of said arcuate wall member and said spring member;

a U shaped disc holder rake member fixedly attached to the first end of said spring member;

a disc holder shaft fixedly positioned in the open end of said U shaped holder; and a plurality of discs fixedly disposed on said disc holder shaft, wherein said rake means follows the irregular motion of the interior wall of said basket, said discs contacting and rubbing said residual explosive nitrocotton layer causing said residual layer to safely break up, due to the pressure applied by said spring member on said disc holder, and to fall by gravity toward the bottom of said wringer basket of said centrifuge.

* * * * *